US005735236A

United States Patent [19]

Kastner et al.

[11] Patent Number: 5,735,236

[45] Date of Patent: Apr. 7, 1998

[54] FOSSIL FUEL-FIRED ONCE-THROUGH FLOW STREAM GENERATOR

[75] Inventors: Wolfgang Kastner, Herzogenaurach; Wolfgang Köhler, Kalchreuth; Eberhard Wittchow, Erlangen, all of Germany

[73] Assignee: Siemens Aktiengesellschaft, Munich, Germany

[21] Appl. No.: 262,466

[22] Filed: Jun. 20, 1994

Related U.S. Application Data

[63] Continuation of PCT/DE92/01054, Dec. 16, 1992.

[30] Foreign Application Priority Data

Dec. 20, 1991 [DE] Germany ..... 41 42 376.3

[51] Int. Cl.[6] ..... F22B 37/00

[52] U.S. Cl. ..... 122/6 A; 122/451 S

[58] Field of Search ..... 122/6 A, 235 A, 122/4 D, 448.4, 451 S

[56] References Cited

U.S. PATENT DOCUMENTS 3,280,799 10/1966 Schroeder .
3,308,792 3/1967 Lawton .
4,869,210 9/1989 Wittchow ..... 122/451 S
5,159,897 11/1992 Franke et al. ..... 122/367.3
5,189,988 3/1993 Budin et al. ..... 122/6 A

FOREIGN PATENT DOCUMENTS 0462486 12/1991 European Pat. Off. .

OTHER PUBLICATIONS

VGB Kraftwerkstechnik 64, Issue 4, Apr. 1984 (Juzi) pp. 292–302.

Book: "Dampferzeugung (Steam Generator)" Dolezzzal pp. 269, 292 and 293.

*Primary Examiner*—Henry A. Bennett
*Assistant Examiner*—Jiping Lu
*Attorney, Agent, or Firm*—Herbert L. Lerner; Laurence A. Greenberg

[57] ABSTRACT

In once-through flow steam generators including a burner for fossil fuels and having a vertical gas flue with essentially vertically disposed tubes, inlet ends of the tubes are connected to an inlet header and outlet ends of the tubes are connected to an outlet header. According to the invention, a pressure-equalization tube branches off from each tube at the same height. The tube is connected to a pressure-equalization vessel. The height H is chosen in such a way that in the case of an individual tube being more strongly heated between the inlet header and the branching-off point of the pressure-equalization tube, the mass flow through the individual tube increases as compared to a mean value of the heating of all of the tubes.

3 Claims, 2 Drawing Sheets

FOSSIL FUEL-FIRED ONCE-THROUGH FLOW STREAM GENERATOR

CROSS-REFERENCE TO RELATED APPLICATION

This application is a Continuation of International Application Serial No. PCT/DE92/01054, filed Dec. 16, 1992.

BACKGROUND OF THE INVENTION

Field of the Invention

The invention relates to a once-through flow steam generator including burners for fossil fuels, having a vertical gas flue with essentially vertically disposed tubes having inlet ends connected to an inlet header and outlet ends connected to an outlet header.

The invention also relates to those once-through steam generators which have a funnel at their lower end. The funnel has at least four walls of tubes being welded together in a gastight manner and also has inlet and outlet headers for the tubes.

In the case of fossil fuel-fired once-through flow steam generators having vertically tubed furnace walls, the tubes at the outlet of the furnace walls are often subject to large temperature differences, because different amounts of heat are transferred to the individual tubes of the bank of parallel tubes. The causes of the different amounts of heat being transferred are to be found in the differences in the heat flux density profile, for example less heat is transferred in the corners of the furnace than close to the burners, as well as in the differences in the heated tube sections, particularly in the funnel area, in the case of once-through flow steam generators being dimensioned for coal firing.

A reduction of the temperature differences at the tube ends is achieved, according to a publication in the VGB Kraftwerkstechnik [Power Station Technology] 64, issue 4, pages 298 and 299, by incorporating throttle orifices and a pressure-equalization header. According to that solution, the individual tubes have throttle orifices at their inlets, in order to adapt the water/steam throughput of individual tubes to the differing degrees of heating and different lengths thereof. Disadvantages of that solution are that the throttle orifices at the tube inlets can only be constructed for a single operational state, and that variable fouling of the furnace walls may, however, give rise to a more than proportional temperature deviation of individual tubes. It has also been found that the throttle orifices may become blocked, as a result of which too little water is supplied to the tubes concerned.

The pressure-equalization header in that instance is disposed in the wet-steam region, i.e. at a place where all of the tubes still have the same temperature, but are passing wet steam of differing steam content, at that point where an average steam content of 80% is achieved at a boiler load of 35%. The entire evaporator mass flow is passed through pressure-equalization headers, with the result that mixing of the wet steam emerging from the individual tubes of the bank of parallel tubes is enforced.

That known pressure-equalization header therefore can give rise to separation of the inflowing wet steam in such a way that individual outgoing tubes preferentially receive water, and others again preferentially receive steam. Consequently, even if the tube walls above the pressure-equalization header are uniformly heated, there will be large differences in the temperature rise of the steam, which will give rise to different tube wall temperatures and thermal stress resulting therefrom, that may lead to tube failures.

SUMMARY OF THE INVENTION

It is accordingly an object of the invention to provide a fossil fuel-fired once-through flow steam generator, which overcomes the hereinafore-mentioned disadvantages of the heretofore-known devices of this general type and in which tube walls of a vertical gas flue are constructed in such a way that in spite of an inevitable differing heating of individual tubes, steam temperatures at outlets of all of the tubes are virtually equal and operational disruptions, such as those caused by possible blockage of throttle orifices at a tube inlet, are avoided.

With the foregoing and other objects in view there is provided, in accordance with the invention, a once-through flow steam generator, comprising burners for fossil fuels; an inlet header; an outlet header; a vertical gas flue including substantially vertically disposed tubes having inlet ends being connected to the inlet header and having outlet ends being connected to the outlet header; a pressure-equalization vessel; pressure-equalization tubes each branching off from a respective one of the tubes at a branching-off point above the burners and at the same height, the pressure-equalization tubes being connected to the pressure-equalization vessel; and a nominal-load mass flow through an individual tube that is more strongly heated between the inlet header and the branching-off point being increased as compared to a mean heating value of all of the tubes.

In accordance with another feature of the invention, the tubes have internal ribs forming a multiple thread, over more than 50% of the length of the tubes.

In accordance with a further feature of the invention, the tubes of the gas flue are welded to one another in a gastight manner.

In accordance with a concomitant feature of the invention, the at a nominal load and with an individual tube receiving a% of incremental heating between the inlet header and the branching-off point, as compared to the mean heating value of all of the tubes corresponding to 100%, a calculated mass flow through the individual tube increases by at least 0.25·a%, or by at least 0.50·a%, or by at least 0.75·a%.

The object of the invention is achieved for once-through flow steam generators by providing a pressure-equalization vessel on the outside of the furnace walls at a height at which it is ensured that a more strongly heated tube has a greater throughput as compared to a parallel tube being subjected to average heating. This is generally the case if the geodesic head drop of a tube subjected to average heating is a multiple of its pressure drop due to friction. The pressure drops relate to that portion of the evaporator tubes which is situated between the header at the inlet into the evaporator and the downstream branch to the pressure-equalization vessel. The condition for increased mass flow in a more strongly heated tube is:

$$\left(\frac{\Delta(\Delta p_{tot})}{\Delta \dot{Q}}\right)_{\dot{M}=const.} = \left(\frac{D(\Delta p_F + \Delta p_G + \Delta p_A)}{D\dot{Q}}\right)_{\dot{M}=const.} < 0 \quad (1)$$

This means that a total pressure drop ($\Delta p_{tot}$) of the tube section under consideration must decrease in the case of stronger heating ($\Delta\dot{Q}$) if the flow rate ($\dot{M}$) is kept constant. In the case of internally ribbed tubes, the pressure drop due to friction ($\Delta p_F$) can be determined according to an article by Q. Zheng, W. Köhler, W. Kastner and K. Riedle, entitled: "Druckverlust in glatten und innenberippten Verdampferrohren, Wärme- und Stoffübertragung" [Pressure Drop in Smooth and Internally Ribbed Evaporator Tubes, Heat and Mass Transfer] 26, p. 323–330, Springer Verlag 1991, while the geodesic head drop ($\Delta p_G$) can be determined according to an article by Z. Rouhani, entitled: "Modified Correlation for Void-Fraction and Two-Phase Pressure Drop", AE-RTV-841, 1969. The pressure drop due to acceleration ($\Delta p_A$) is of comparatively little significance and can be ignored in this calculation.

According to the invention, however, the mass flow in a tube subjected to stronger heating should not remain constant, but should rise ($\Delta\dot{M}>0$). This is the case in a bank of parallel tubes if equation (1) is met. The following relation therefore applies to the more strongly heated tube:

$$\frac{\Delta\dot{M}}{\Delta\dot{Q}} > 0 \tag{2}$$

Equation (2) still does not say anything about the extent of the mass flow increase. The aim would be for an increase which just completely compensates for the stronger heating. In that case, even in a tube subjected to stronger heating, the same heat increment, i.e. the same enthalpy increase, would apply as in the tubes subjected to average heating, which would result in a very large decrease of the described temperature difference down to zero. The condition for this is:

$$\frac{\Delta\dot{M}}{\Delta\dot{Q}} = \left(\frac{\dot{M}}{\dot{Q}}\right)_{ref.} \tag{3}$$

The index "ref" in this case refers to a reference tube with a mean flow rate $\dot{M}$ and a mean heat absorption $\dot{Q}$.

In practice it will not always be possible to meet the condition stated in equation (3). The altitude of the pressure-equalization vessel, i.e. the incorporation of the pressure-equalization vessel into the bank of parallel tubes of the vertically disposed tubes, which are internally ribbed over at least part of their length, is therefore chosen in such a way that one of the following conditions does apply:

$$\frac{\Delta\dot{M}}{\Delta\dot{Q}} > 0 \tag{4}$$

$$\frac{\Delta\dot{M}}{\Delta\dot{Q}} > 0.25\left(\frac{\Delta\dot{M}}{\Delta\dot{Q}}\right)_{ref} \tag{5}$$

$$\frac{\Delta\dot{M}}{\Delta\dot{Q}} > 0.50\left(\frac{\dot{M}}{\dot{Q}}\right)_{ref} \tag{6}$$

$$\frac{\Delta\dot{M}}{\Delta\dot{Q}} > 0.75\left(\frac{\dot{M}}{\dot{Q}}\right)_{ref} \tag{7}$$

While this flow construction produces different flow rates for all of the parallel tubes when they are heated differently, their steam contents (in the case of wet steam) or their temperatures (in the case of superheated steam) are approximately the same, and therefore it is not necessary to put the entire mass flow through the pressure-equalization header. Putting the entire mass flow through the pressure-equalization header would even be disadvantageous, because the risk of the water/steam mixture separating would arise once again. Therefore, only one pressure-equalization vessel is provided, through which only a part of the total wet-steam stream flows. This self-adjusting partial-stream gives rise not only to greater uniformity of the flow distribution and to a flow distribution which is matched to the heating profile in the parallel tubes between the inlet header and the outgoing pressure-equalization tubes to the pressure-equalization vessel, but also, through the pressure-equalization tubes, it supplies an additional mass flow to tubes having a lower flow, as a result of which there is an almost uniform flow distribution in the tubes between the pressure-equalization tubes and the downstream outlet header. The risk of separation of the wet steam into water and steam does not arise, and therefore all of the tubes at the upper end of the tube walls have an approximately equal temperature, and damage due to thermal stress cannot occur.

Other features which are considered as characteristic for the invention are set forth in the appended claims.

Although the invention is illustrated and described herein as embodied in a fossil fuel-fired once-through flow steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
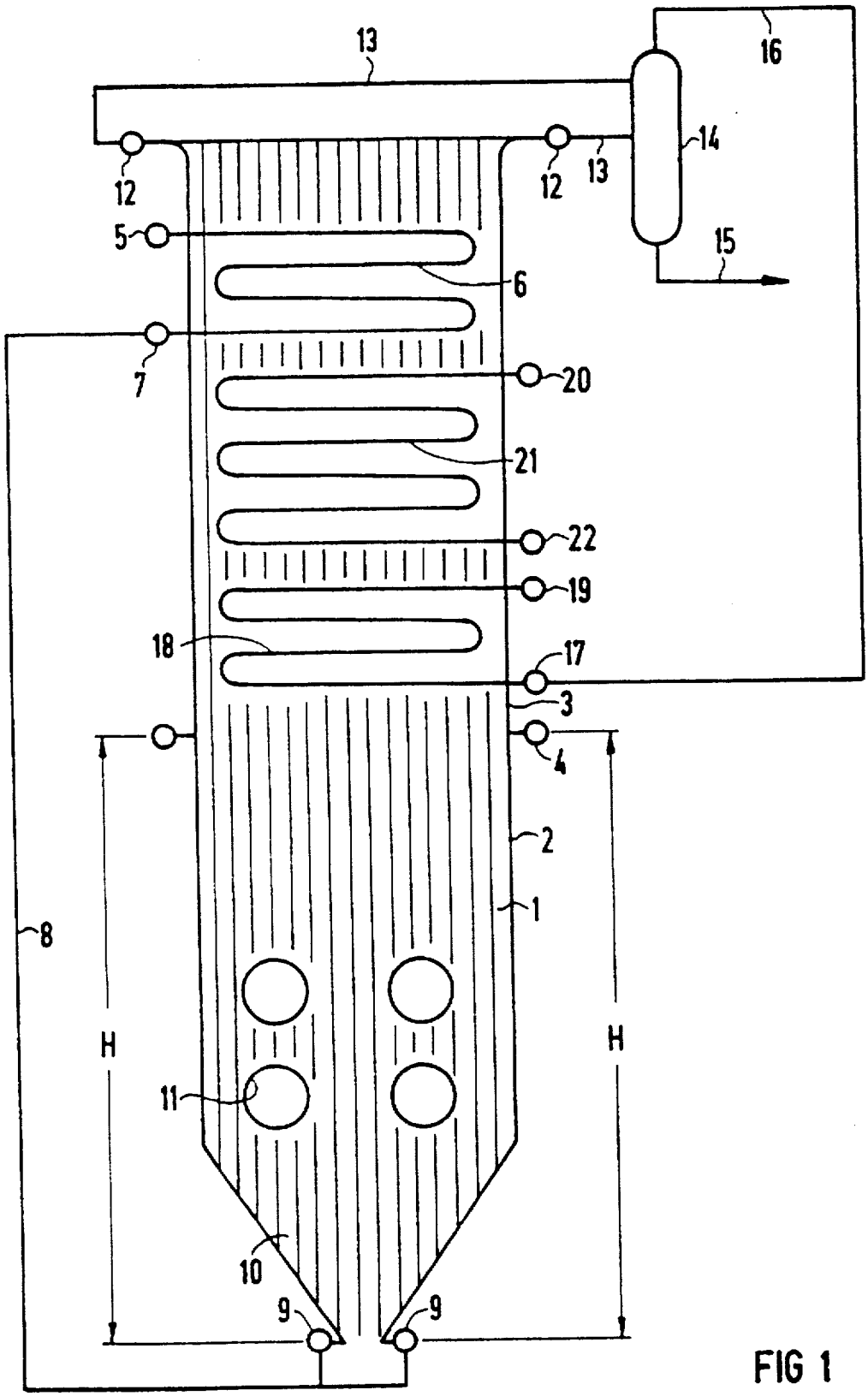
FIG. 1 is a diagrammatic, longitudinal-sectional view of a once-through flow steam generator in a simplified representation.

Referring now to the figures of the drawing in detail and first, particularly, to FIG. 1 thereof, there is seen a once-through flow steam generator having a vertical gas flue 1 which includes tube walls that are welded together in a lower part in a gastight manner from tubes 2 which are disposed vertically and next to one another. The tube walls have an upper part in which they include tubes 3 that are disposed vertically and next to one another and are similarly welded to one another in a gastight manner. The tubes that are welded together in a gastight manner form a gastight tube wall, for example in a tube/web/tube construction or in a finned-tube construction.

The vertical gas flue 1 has a lower end with a funnel 10 for collecting ash, having peripheral walls that are also formed by the tube walls. In a lower part of the vertical gas flue 1, main burners 11 for fossil fuel are disposed.

The tubes 2 have inlet ends at which they are connected to an inlet header 9 and they have outlet ends directly joining inlet ends of the tubes 3 at a height H, as measured from a central axis of the inlet headers 9. The tubes 3 have outlet ends which are connected to an outlet header 12.

The outlet headers 12 are connected through connection lines 13 to a separator 14, to which a drain line 15 and a connection line 16 are connected.

The connection line 16 leads to an inlet header 17 of a superheater heating surface 18, having tube outlet ends which are connected to a superheater outlet header 19. Additionally, an intermediate superheater heating surface 21 having an inlet header 20 and an outlet header 22, and an economizer heating surface 6 having an inlet header 5 and an outlet header 7, are disposed within the vertical gas flue 1. The outlet header 7 is connected through a connection line 8 to the inlet header 9.

Figure 2:
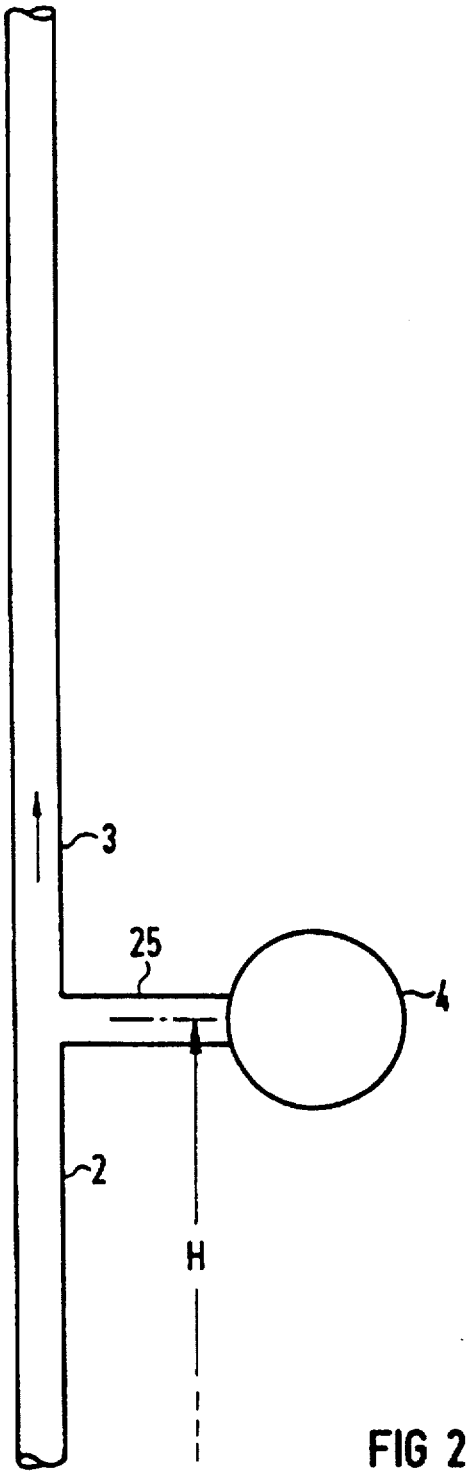
FIG. 2 is an enlarged longitudinal-sectional view of a single tube from a vertically tubed part of the once-through flow steam generator wherein the tube is connected to a pressure-equalization vessel.

FIG. 2 shows a single tube 2 having its outlet end which directly joins the inlet end of a tube 3 at the height H, where a pressure-equalization tube 25 branches off. The pressure-equalization tube 25 is connected to a pressure-equalization vessel 4, which is disposed outside the vertical gas flue 1. A pressure-equalization tube 25 branches off from each of the tubes 2 of the tube walls.

A non-illustrated feed pump delivers water into the inlet header 5 and from there into the economizer heating surface 6, in which the water is preheated. The water then flows through the connection line 8 and the inlet header 9 into the tubes 2 of the tube walls of the vertical gas flue 1, where most of it evaporates. The remaining evaporation and the first part of superheating take place in the tubes 3 of the tube walls of the vertical gas flue 1.

The separator 14 only operates during the start-up procedure, i.e. up to the point where not all of the water is evaporated within the tube walls, due to insufficient heat supply. In the separator 14 the inflowing water/steam mixture is then separated. The separated water is passed through the drain line 15, for example to a flash vessel, and the separated steam flows through the connection line 16 to the superheater heating surface 18.

In the intermediate superheater heating surface 21, the steam which is expanded in the high-pressure part of the steam turbine is reheated.

The mass flow density in the vertically disposed tubes 2 and 3 is chosen in such a way as to make the geodesic head drop in the tubes considerably larger than the pressure drop due to friction. As a result, a tube subject to stronger heating receives a higher flow rate, and therefore the effect of the stronger heating on the outlet temperature is very largely compensated for. In the case of very long vertical evaporator tubes, such as those that are used, for example, in once-through flow steam generators in single-pass construction, even at a low mass flow density of 1000 $kg/m^2s$ or less, based on a load of 100%, the pressure drop due to friction in the tubes of the upper part of the vertical gas flue, i.e. in the tubes 3, increases strongly because of the large volumes of steam. It is then possible for the pressure drop due to friction to become so large in relation to the geodesic head drop that the flow rate through a more strongly heated tube is reduced as compared to the parallel tubes and that, as a result, undesirably high steam-temperatures are produced at the end of the tube.

The configuration of the pressure-equalization vessel 4 has the effect of decoupling the tubes 2 from the tubes 3 with respect to the pressure drop. All of the tubes 2, through which a flow passes from bottom to top and which, in terms of flow, are disposed in parallel, have the same pressure drop between the inlet header 9 and the pressure-equalization vessel 4. The proportion of the geodesic head drop of this pressure drop is a multiple of the proportion of the pressure drop due to friction, which means that the benefit of the increased flow rate in the case of stronger heating of individual tubes is very effective. This is particularly important in the lower part of the vertical gas flue 1, where the differences in heating in the area of the funnel and the main burners are particularly pronounced.

In the upper part of the vertical gas flue 1, where the tubes 3 are located, both the heating and the non-uniformity thereof are less strong than in the lower part of the gas flue 1. The pressure-equalization vessel 4 has the effect of causing a partial-stream to flow through part of the pressure-equalization tubes 25 from the tubes 2 to the pressure-equalization vessel 4, and of causing a partial-stream to flow through another part of the pressure-equalization tubes 25 from the pressure-equalization vessel 4 to the tubes 3. As a result, uniform flow through the tubes 3 is achieved, in spite of the unequal flow through the tubes 2 and even if there are large differences in the heating thereof.

This effect, according to the invention, becomes particularly pronounced if the pressure-equalization vessel is connected to the bank of parallel tubes at an altitude such that, at a 100% load and with an individual tube receiving a% of incremental heating, the mass flow through this individual tube, depending on the other constraints, rises either by at least 0.25·a% or by 0.50·a% or by 0.75·a%.

The cooling of the tubes 2 and 3 is improved, and the tube wall temperature is thus reduced, if the tubes have internal ribs which form a multiple thread. This is particularly necessary in the areas of high heat irradiation, for example in the area of the burners 11. The ribs forming the multiple thread expediently extend over more than 50% of the length of the tubes 2.

As compared to configurations using known pressure-equalization headers, there is the possibility that the mass flow density achieved by the solution according to the invention, which has a pressure-equalization vessel and has internally ribbed tubes in the area of the flame chamber, will be less than 1000 $kg/m^2s$ at full load, because of the good heat transfer properties of internally ribbed tubes.

We claim:

1. A once-through flow steam generator, comprising:

burners for a fossil fuel;

an inlet header;

an outlet header;

a vertical gas flue including substantially vertically disposed tubes for channeling steam, said substantially vertically disposed tubes each having inlet ends being connected to said inlet header and, said substantially vertically disposed tubes each having outlet ends being connected to said outlet header and said outlet ends delivering the steam to said outlet header with a specified temperature;

said vertical gas flue having a lower end and said burners being disposed in said lower end for heating said substantially vertically disposed tubes;

a pressure-equalization vessel;

pressure-equalization tubes each branching off from a respective one of said substantially vertically disposed tubes at a branching-off point above said burners and at a same height, said pressure-equalization tubes being connected to said pressure-equalization vessel; and said height of said branching-off point of each of said substantially vertically disposed tubes is chosen such that it is ensured that the geodesic pressure drop in said substantially vertically disposed tubes is at least a multiple of a pressure drop due to friction in said substantially vertically disposed tubes.

2. The once-through flow steam generator according to claim 1, wherein said substantially vertically disposed tubes have internal ribs forming a multiple thread, over more than 50% of the length of said tubes.

3. The once-through flow steam generator according to claim 1, including at least one weldment gas-tightly joining said substantially vertically disposed tubes of said gas flue.

* * * * *

UNITED STATES PATENT AND TRADEMARK OFFICE

CERTIFICATE OF CORRECTION

PATENT NO. : 5,735,236
DATED : April 7, 1998
INVENTOR(S) : Wolfgang Kastner et al.

It is certified that error appears in the above-indentified patent and that said Letters Patent is hereby corrected as shown below:

On the title page item [54] and column 1, lines 1-2 should read as follows:

FOSSIL FUEL-FIRED ONCE-THROUGH FLOW STEAM GENERATOR

Signed and Sealed this

Eighteenth Day of August, 1998

Bruce Lehman

*Attest:*

BRUCE LEHMAN

*Attesting Officer*

*Commissioner of Patents and Trademarks*